US006960013B2

(12) United States Patent
Steffen et al.

(10) Patent No.: US 6,960,013 B2
(45) Date of Patent: Nov. 1, 2005

(54) HIGH FREQUENCY IMMERSION VIBRATOR COMPRISING A COOLED ELECTRONIC FREQUENCY CONVERTER

(75) Inventors: Michael Steffen, Stockdorf (DE); Christian Glanz, Dachau (DE); Dirk Sibila, Moorenweis (DE); Thomas Müller, Munich (DE)

(73) Assignee: Wacker Construction Equipment AG, Munich (DE)

( * ) Notice: Subject to any disclaimer, the term of this patent is extended or adjusted under 35 U.S.C. 154(b) by 16 days.

(21) Appl. No.: 10/250,960

(22) PCT Filed: Jan. 11, 2002

(86) PCT No.: PCT/EP02/00224

§ 371 (c)(1),
(2), (4) Date: Nov. 3, 2003

(87) PCT Pub. No.: WO02/057570

PCT Pub. Date: Jul. 25, 2002

(65) Prior Publication Data

US 2004/0061457 A1 Apr. 1, 2004

(30) Foreign Application Priority Data

Jan. 12, 2001 (DE) ..... 101 01 277

(51) Int. Cl.[7] ..... B01F 11/00; E04G 21/08
(52) U.S. Cl. ..... 366/123; 366/147
(58) Field of Search ..... 366/108–128, 366/144–149

(56) References Cited

U.S. PATENT DOCUMENTS 1,989,409 A * 1/1935 Gordon ..... 264/69
5,108,189 A * 4/1992 Oswald ..... 366/123
5,202,612 A * 4/1993 Yoshida et al. ..... 318/138
5,556,199 A * 9/1996 Oswald ..... 366/120
5,725,304 A * 3/1998 Inai ..... 366/120
6,084,327 A * 7/2000 Steffen ..... 310/81
6,109,111 A * 8/2000 Heimbruch et al. ..... 73/660
6,619,832 B1 * 9/2003 Steffen ..... 366/120
6,733,169 B2 * 5/2004 Steffen ..... 366/120
6,811,297 B2 * 11/2004 Oswald ..... 366/122
2002/0131323 A1 * 9/2002 Oswald ..... 366/122
2003/0012041 A1 * 1/2003 Steffen
2003/0198123 A1 * 10/2003 Steffen ..... 366/120
2004/0208080 A1 * 10/2004 Oswald et al. ..... 366/123

FOREIGN PATENT DOCUMENTS

CH 578665 A5 * 6/1976
CH 689598 A5 * 6/1999
DE 198 15 655 C 8/1999

(Continued)

*Primary Examiner*—Charles E. Cooley
(74) *Attorney, Agent, or Firm*—Boyle Fredrickson Newholm Stein & Gratz S.C.

(57) ABSTRACT

An electronic frequency converter is used with a high frequency immersion vibrator in order to compact concrete. The frequency converter comprises a cooling circuit containing a cooling medium; a first heat exchanger which is integrated into said cooling circuit and is used to transmit heat generated in the housing of the frequency converter to the cooling medium; and a second heat exchanger which is integrated into the cooling circuit and is used to outwardly transmit heat absorbed by the cooling medium. The second heat exchanger is received in a vibrator housing of the high frequency immersion vibrator. If the vibrator housing is immersed in concrete, the heat produced in the converter housing can be conducted away to the concrete.

9 Claims, 2 Drawing Sheets

FOREIGN PATENT DOCUMENTS

| | | | | |
|---|---|---|---|---|
| DE | 199 00 348 | A | | 7/2000 |
| DE | 199 13 305 | A | | 10/2000 |
| EP | 916785 | A1 | * | 11/1998 |
| JP | 2-221557 | | * | 9/1990 |
| JP | 6-220994 | | * | 8/1994 |
| JP | 9-291703 | | * | 11/1997 |
| WO | 00/24114 | | * | 4/2000 |
| WO | 02/057570 | A1 | * | 7/2005 |

* cited by examiner

HIGH FREQUENCY IMMERSION VIBRATOR COMPRISING A COOLED ELECTRONIC FREQUENCY CONVERTER

BACKGROUND OF THE INVENTION

1. Field of the Invention

The present invention relates to an electronic frequency converter for a high-frequency immersion vibrator for the compacting of concrete.

2. Description of the Related Art

In the processing of fresh concrete heaps, in order to achieve adequate solidity and tightness of the concrete it is indispensably necessary to remove structural disturbances and air enclosures that arise during the pouring of the concrete, by compacting the concrete. For this purpose, vibrations in the form of high-frequency oscillations are introduced into the fresh concrete heaps, using vibration devices. The vibration devices most often used for this purpose at construction sites are what are known as poker vibrators or immersion vibrators.

Besides the introduction of a particular energy, the form and the frequency of the introduced vibrations are centrally important for an effective compacting of the concrete. In most cases of application, an operating frequency of 200 Hz has turned out to be optimal for the use of immersion vibrators. In order to provide such high-frequency oscillations, immersion vibrators have been widely successful on the market in which a high-frequency electric motor is built into a bottle element that acts as a vibrator housing. These devices are operated via separate mechanical or electronic frequency and voltage converters. However, due to the converters, which are provided separately from the immersion vibrators and whose weight and size give them only limited portability, the radius of possible use of such immersion vibrators on the construction site is considerably limited.

From DE 92 17 854 U, an immersion vibrator for compacting concrete is known that is operated with a high-frequency electric motor. Here, a frequency converter is combined with an actuating switch of the electric motor to form a miniaturized constructive unit, and is housed in a switch housing. In this way, in contrast to conventional high-frequency immersion vibrators, it is possible to do without additional frequency converters, which considerably simplifies the handling of this immersion vibrator for an operator. In addition, here the radius of use of the immersion vibrator is improved as a result of the reduced dimensions of the switch housing and a reduction in weight connected therewith. However, the dimensions of the switch housing cannot be adapted completely to electronic frequency converters having ever-smaller constructions, because an adequate dissipation of heat that is generated during the operation of the frequency converter must be ensured by means of convection via the surface of the switch housing. A further miniaturization of the switch housing would have the disadvantageous consequence that an adequate heat dissipation to the environment would not be ensured, and the frequency converter could thus fail as the result of thermal overloading.

OBJECTS AND SUMMARY OF THE INVENTION

The underlying object of the present invention is to indicate a high-frequency immersion vibrator comprising an electronic frequency converter that can be operated in thermally stable fashion and thus can be used without disturbance in practical operation.

According to the present invention, this object is achieved by an electronic frequency converter that includes a cooling circuit with coolant, a first heat exchanger integrated into the cooling circuit for transferring heat generated in the converter housing to the coolant and a second heat exchanger integrated into the cooling circuit for transferring the heat absorbed by the coolant to the exterior.

An electronic frequency converter according to the present invention for a high-frequency immersion vibrator for compacting concrete, in which at least a portion of the components of the frequency converter is situated in a converter housing, is characterized by a cooling circuit having a coolant contained therein, a first heat exchanger, integrated into the cooling circuit, for transferring heat generated in the converter housing to the coolant, and by a second heat exchanger, integrated into the cooling circuit, for transferring heat absorbed by the coolant to the exterior.

The cooling circuit, and the first and second heat exchangers integrated therein, effect a very good cooling of the frequency converter through an efficient dissipation of heat from the converter housing to the exterior, so that the frequency converter is protected against failure resulting from a buildup of heat in the converter housing. A conventional dissipation of heat via convection is supplemented by a transfer of heat to the coolant and a subsequent dissipation of heat to the exterior, so that, in contrast to known frequency converters not having a cooling circuit, a miniaturization of a surface of the converter housing is possible without adversely effecting the operational reliability of the frequency converter. In this way, it is possible to achieve a further miniaturization of the converter housing, and, connected therewith, an improved handling of the frequency converter in practical use.

In a possible specific embodiment of the present invention, the first heat exchanger is situated at or on the converter housing. Here, the first heat exchanger is allocated to heat-generating components of the frequency converter that are housed in the converter housing, in such a way that heat generated by these components can be transferred to the coolant by the first heat exchanger. In the same way, tubes, forming for example a part of the cooling circuit, can be situated on an external surface of the converter housing. In addition, the second heat exchanger is provided separately from the converter housing, in order to transfer heat absorbed by the coolant to the exterior.

A particularly advantageous specific embodiment of the present invention is characterized in that the above-sided part of the cooling circuit that can for example be realized in the form of tubes is formed inside the converter housing. In this way, this part of the cooling circuit is very well-shielded against external influences that can occur, for example as impacts. In order to provide similar damage protection for the first heat exchanger, this heat exchanger can also be accommodated in the converter housing. Here it is possible to situate the first heat exchanger either in the vicinity of the heat-generating components, or, alternatively, to fasten it directly to these heat-generating components. Overall, the electronic frequency converter can be realized in very robust fashion through the integration of the first heat exchanger and a portion of the cooling circuit inside the converter housing.

The coolant used together with the cooling circuit can be a cooling fluid, or, alternatively, can be a cooling gas. In a particularly advantageous embodiment, the coolant is circulated in the cooling circuit by a pump, a throughput of the pump being adapted correspondingly to the dimensioning of the first and second heat exchanger. With regard to simple handling of the frequency converter, it is advantageous that the converter housing is combined with the pump to form a constructive unit. Here it is in particular advantageous that the pump is integrated into the converter housing so that it s protected against external influences.

An advantageous further development of the present invention is characterized in that a manual switch for actuating the electronic frequency converter is integrated into the converter housing. Using such a manual switch, the frequency converter can be switched on or off directly at the converter housing.

With respect to a problem-free use at the construction site, it is in addition particularly advantageous if the electronic frequency converter can be operated using network alternating current. In this case, the frequency converter can be plugged, using a normal plug, directly into the lighting power network, having for example 230 V and 50 Hz.

A particularly advantageous specific embodiment of the present invention provides a high-frequency immersion vibrator for compacting concrete, comprising a vibrator housing in which there are situated an imbalance mass and an electric motor, operating at a frequency higher than network frequency, for driving the imbalance mass, and comprising a frequency converter, housed in a converter housing, for supplying the electric motor, and comprising a protective hose that connects the vibrator housing and the converter housing, and is characterized in that the frequency converter is an electronic frequency converter according to the present invention. The above-named advantages with respect to the ease of handling of the frequency converter according to the present invention thus facilitate, in the same manner, the practical use of the high-frequency immersion vibrator.

It is particularly advantageous that a further part of the cooling circuit of the frequency converter is formed in the protective hose and in the vibrator housing, the second heat exchanger being situated inside the vibrator housing. The coolant circulated by the pump flows through the second heat exchanger, whereby the heat absorbed by the coolant is transferred to the vibrator housing. For the case in which the vibrator housing is immersed in the concrete to be compacted, it is thus advantageously possible to drain the heat transferred to the vibrator housing subsequently to the concrete, which has a good cooling effect.

A further particularly advantageous specific embodiment of the high-frequency immersion vibrator is characterized by an acquisition device through which an alteration of the motor current supplied to the electric motor can be acquired, and by a temperature protection switching device, which can be controlled by the acquisition device, for switching the pump on and off. In the practical use of the immersion vibrator, the vibrator housing is not immersed in the concrete to be compacted in uninterrupted fashion, but rather is withdrawn briefly from the concrete as necessary in order to be immersed again at a different location. If, during operation, the vibrator housing is not situated in the concrete, but for example is suspended freely in the air, very high temperatures develop immediately in the vibrator housing, and the motor current supplied to the electric motor decreases. For this reason, when there is a decrease in the motor current acquired by the acquisition device, the pump can be switched off by the temperature protection switching device. The resulting interruption of the circulation of the coolant prevents the heat generated by the electric motor in the vibrator housing, and in this case transferred to the coolant via the second heat exchanger, from being transferred back to the first heat exchanger as a consequence of the circulation of the coolant, which would result in a disadvantageous additional heating of the frequency converter, which in itself is not heavily stressed at this time.

As soon as the vibrator housing is immersed again in the concrete after having been withdrawn, the motor current supplied to the electric motor increases. Correspondingly, when the acquisition device acquires an increase of the motor current, the pump can be switched on by the temperature protection switching device, so that an advantageous transfer of heat from the vibrator housing to the cool concrete can take place.

BRIEF DESCRIPTION OF THE DRAWINGS

These and additional advantages and features of the present invention are explained in more detail below with the help of the following exemplary specific embodiment illustrated in the drawings in which.

DETAILED DESCRIPTION OF THE PREFERRED EMBODIMENTS

Figure 1:
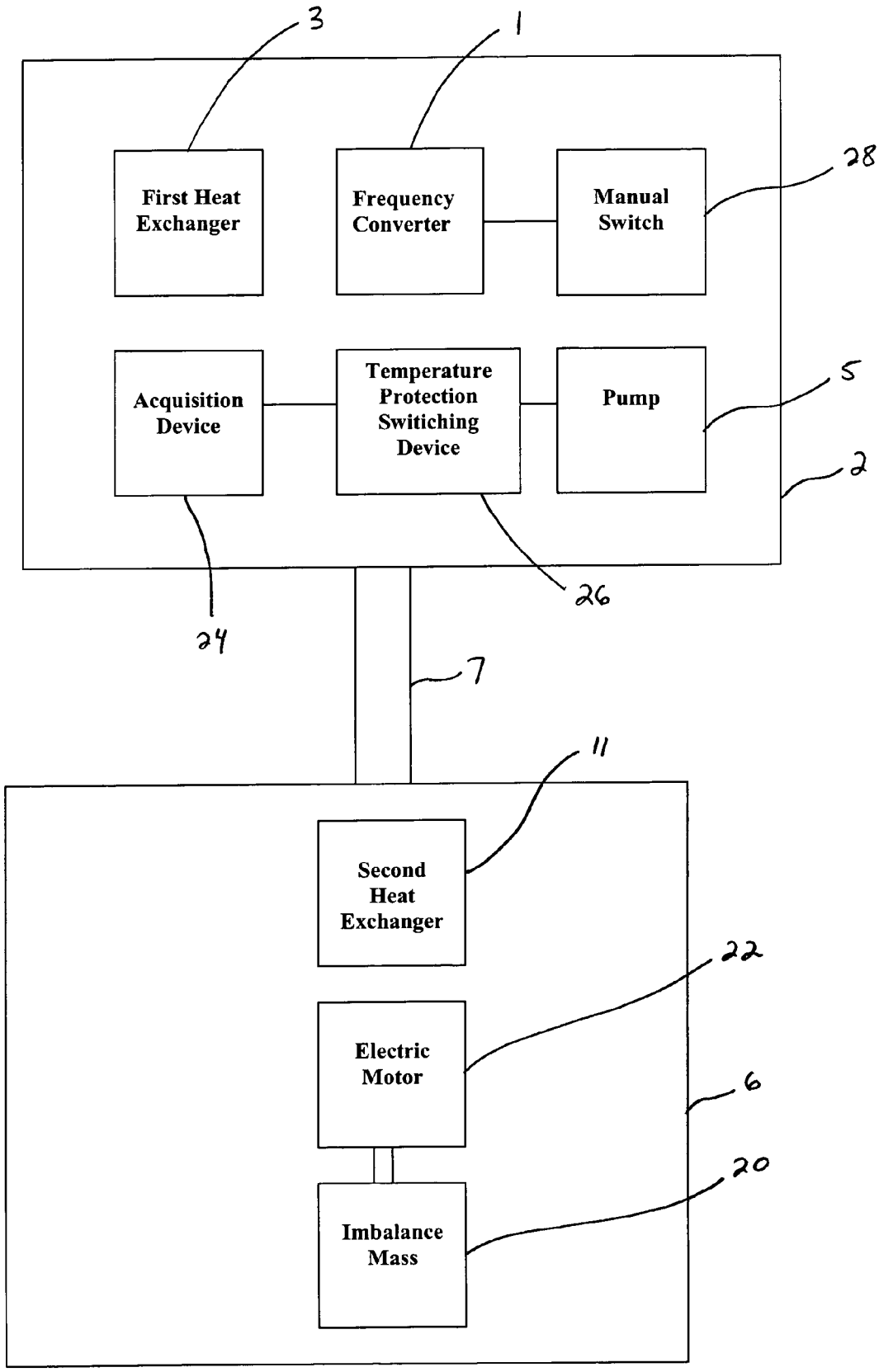
FIG. 1 is a schematic plan view of a high-frequency immersion vibrator for compacting concrete.
Figure 2:
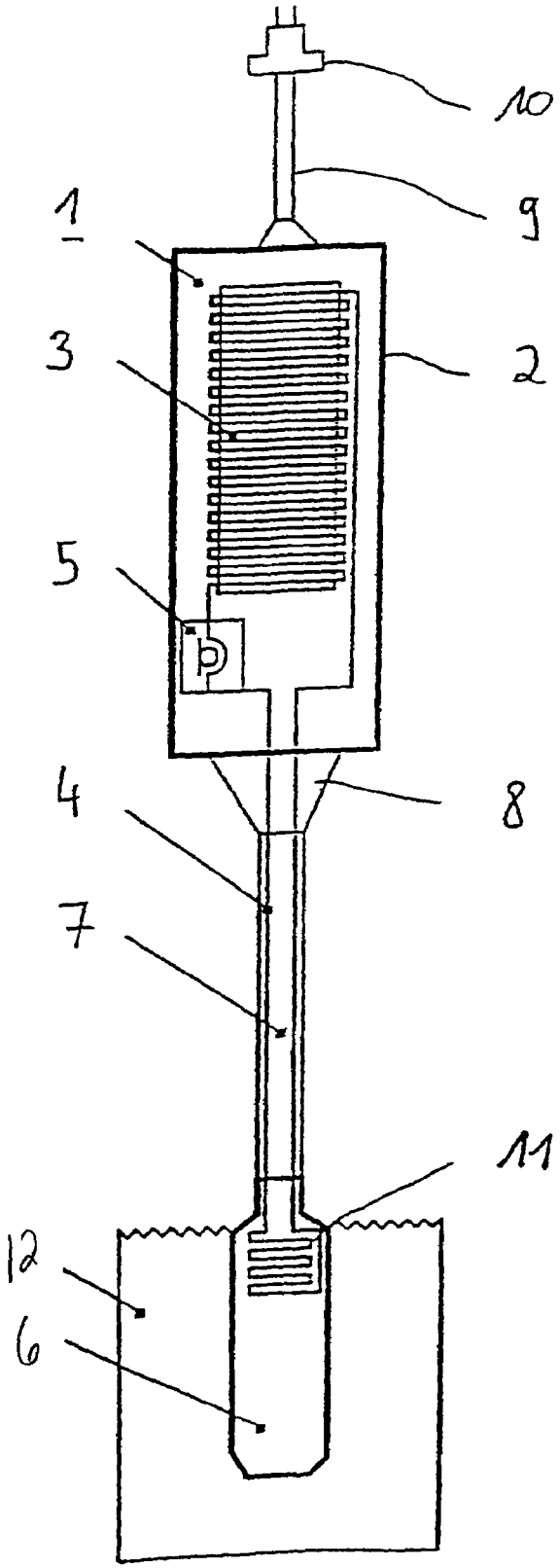
FIG. 2 shows a schematic plan view of the electronic frequency converter of the high-frequency immersion vibrator of FIG. 1 according to the present invention.

FIGS. 1 and 2 illustrate a high-frequency immersion vibrator for compacting concrete that includes an electronic frequency converter. Electronic frequency converter 1 shown in FIGS. 1 and 2 comprises a converter housing 2 and a first heat exchanger 3 that is situated inside converter housing 2 in the vicinity of heat-generating components (not shown) of frequency converter 1. First heat exchanger 3 can be fixed to a wall of converter housing 2, for example by means of a mount. Alternatively, first heat exchanger 3 can be fastened directly to the heat-generating components. Due to its being situated in the interior of converter housing 2, first heat exchanger 3 is protected very well against damaging external influences, which cannot be ruled out during use on a construction site. As shown in FIG. 1, a manual switch 28 for switching the frequency converter 1 on and off is integrated into the converter housing 2.

The preferred high-frequency immersion vibrator also includes an acquisition device 24 through which an alteration of the motor current supplied to the electric motor 22 can be acquired and a temperature protection switching device 26, which can be controlled by the acquisition device 24, for switching the pump 5 on and off. Preferably the pump 5 can be switched off by the temperature protection switching device 26 when there is a decrease in the motor current acquired by the acquisition device 24, and the pump 5 can be switched on by the temperature protection switching device 26 when there is an increase in the motor current acquired by the acquisition device 24.

In addition, frequency converter 1 according to the present invention has a cooling circuit 4 into which first heat exchanger 3 is integrated. Cooling circuit 4 contains a coolant (not shown) that is a cooling fluid or a cooling gas. Via first heat exchanger 3, heat produced by the heat-generating components of frequency converter 1 is transferred to the coolant. In addition, frequency converter 1 comprises a pump 5 that is combined with converter housing 2 to form a constructive unit. Here, pump 5 is accommodated in converter housing 2 in the same way as is first heat exchanger 3, in order to protect against external damages.

The above-named cooling circuit 4 is formed by a tube or hose system, and a portion of cooling circuit 4 runs inside converter housing 2. In this way, the tubes, which in general are sensitive to impacts, are effectively protected against damage. Pump 5 is connected with cooling circuit 4 in such a manner that the coolant can be circulated in cooling circuit 4 by the pump.

As is further shown in FIG. 2, frequency converter 1 is a component of a high-frequency immersion vibrator that additionally comprises a vibrator housing 6 and a protective hose 7.

An imbalance mass 20 and an electric motor 22 for driving the imbalance mass are situated in the interior of vibrator housing 6 in a known manner. In order to be able to ensure the high-frequency oscillations that are required for the concrete compacting, frequency converter 1 supplies the electric motor with a voltage whose frequency is preferably in the area of 200 Hz, and is thus higher than the standard network frequency of 50 Hz. One end of protective hose 7 is connected with vibrator housing 6, while another end of protective hose 7 is attached to converter housing 2 via a coupling device 8. Protective hose 7 has a flexible construction in order to ensure problem-free handling, and its outer diameter is dimensioned such that it can easily be grasped by an operator, so that it can also act as an operating hose. In order to enable easy performance of repairs and maintenance work that may be required, in a variant of frequency converter 1 according to the present invention protective hose 7 can easily be removed from vibrator housing 6 or, via coupling device 8, from converter housing 2.

At one side of converter housing 2, a power supply cable 9 having a plug 10 is led out. Via power supply cable 9 and plug 10, electronic frequency converter 1 can be operated with standard network alternating current, the normal alternating current frequency of 50 Hz being increased by the converter to values of up to 200 Hz. In protective hose 7, electrical lines (not shown) are accommodated that connect an output of frequency converter 1 with the electric motor situated in vibrator housing 6. In this way, the electric motor can be supplied with a high-frequency voltage outputted by frequency converter 1.

In addition, frequency converter 1 has a second heat exchanger 11 that is integrated into cooling circuit 4 and is situated inside vibrator housing 6. A portion of cooling circuit 4 runs inside protective hose 7, and leads from converter housing 2 to second heat exchanger 11.

Through the operation of pump 5, it is ensured that the coolant contained in cooling circuit 4 moves from first heat exchanger 3 through protective hose 7 to second heat exchanger 11. The heat transferred to the coolant by first heat exchanger 3 is now emitted to vibrator housing 6 via second heat exchanger 11. Subsequently, the coolant circulates through protective hose 7 back in the direction of first heat exchanger 3.

As is further schematically shown in the FIG. 2, during operation vibrator housing 6 is immersed in the still-fresh concrete 12 that is to be processed. Because in general the concrete has a relatively low temperature in relation to frequency converter 1, the heat transferred from second heat exchanger 11 to vibrator housing 6 can subsequently be carried off efficiently to the cooling concrete 12.

The above-explained frequency converter 1 according to the present invention can be operated with great reliability in a thermally non-critical state over a long time duration.

Due to the cooling of frequency converter 1, the outer dimensions of converter housing 2 can be further miniaturized without leading to a disturbance or failure of frequency converter 1 as a consequence of an inadequate convection cooling of converter housing 2.

What is claimed is:

1. A high-frequency immersion vibrator for compacting concrete, comprising:

a vibrator housing in which there are situated an imbalance mass and an electric motor, operating at a frequency higher than network frequency, for driving the imbalance mass;

an electronic frequency converter for supplying the electric motor, at least a portion of the components of the frequency converter (1) being situated in a converter housing;

a protective hose that connects the vibrator housing and the converter housing;

a cooling circuit having a coolant contained therein;

a first heat exchanger, integrated into the cooling circuit and situated in the converter housing, for transferring heat generated in the converter housing to the coolant; and comprising a second heat exchanger, integrated into the cooling circuit, for transferring heat absorbed by the coolant to the exterior;

wherein the second heat exchanger is provided separately from the converter housing.

2. The high-frequency immersion vibrator as recited in claim 1, wherein a portion of the cooling circuit is formed inside the converter housing.

3. The high-frequency immersion vibrator as recited in claim 1, wherein the coolant can be circulated in the cooling circuit by a pump.

4. The high-frequency immersion vibrator as recited in claim 3, wherein the converter housing is combined with the pump to form a constructive unit.

5. The high-frequency immersion vibrator as recited in claim 3, wherein the pump is integrated into the converter housing.

6. The high-frequency immersion vibrator as recited in claim 3, further comprising an acquisition device through which an alteration of the motor current supplied to the electric motor can be acquired; and a temperature protection switching device, which can be controlled by the acquisition device, for switching the pump on and off; whereby the pump can be switched off by the temperature protection switching device when there is a decrease, acquired by the acquisition device, in the motor current; and whereby the pump can be switched on by the temperature protection switching device when there is an increase, acquired by the acquisition device, in the motor current.

7. The high-frequency immersion vibrator as recited in claim 1, wherein a manual switch for switching the frequency converter on and off is integrated into the converter housing.

8. The high-frequency immersion vibrator as recited in claim 1, wherein the electronic frequency converter can be operated using network alternating current.

9. A high-frequency immersion vibrator as recited in claim 1, wherein an additional part of the cooling circuit is formed in the protective hose and in the vibrator housing, and that the second heat exchanger is situated in the vibrator housing in order to transfer heat absorbed by the coolant to the vibrator housing.

* * * * *